US009470059B2

(12) United States Patent
Zhou

(10) Patent No.: US 9,470,059 B2
(45) Date of Patent: Oct. 18, 2016

(54) BOTTOM HOLE ASSEMBLY FOR DEPLOYING AN EXPANDABLE LINER IN A WELLBORE

(75) Inventor: Shaohua Zhou, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 976 days.

(21) Appl. No.: 13/565,247

(22) Filed: Aug. 2, 2012

(65) Prior Publication Data

US 2013/0068481 A1 Mar. 21, 2013

Related U.S. Application Data

(60) Provisional application No. 61/536,789, filed on Sep. 20, 2011.

(51) Int. Cl.

| | |
|---|---|
| ***E21B 23/00*** | (2006.01) |
| ***E21B 10/32*** | (2006.01) |
| ***E21B 33/127*** | (2006.01) |
| ***E21B 43/10*** | (2006.01) |
| ***E21B 23/04*** | (2006.01) |
| ***E21B 21/00*** | (2006.01) |

(52) U.S. Cl.

CPC ..... *E21B 33/127* (2013.01); *E21B 21/003* (2013.01); *E21B 23/04* (2013.01); *E21B 43/10* (2013.01); *E21B 43/105* (2013.01); *E21B 43/108* (2013.01)

(58) Field of Classification Search

CPC .... E21B 21/003; E21B 23/04; E21B 33/127; E21B 43/10; E21B 43/105; E21B 43/108; E21B 43/106; E21B 17/1064

See application file for complete search history.

(56) References Cited

U.S. PATENT DOCUMENTS

| | | | | |
|---|---|---|---|---|
| 3,477,506 | A | 11/1969 | Malone | |
| 5,049,003 | A | 9/1991 | Barton | |
| 5,119,862 | A | 6/1992 | Maimets et al. | |
| 5,186,215 | A | 2/1993 | Gilleland | |
| 5,334,429 | A | 8/1994 | Imoto et al. | |
| 5,375,662 | A * | 12/1994 | Echols et al. | 166/386 |
| 6,250,385 | B1 | 6/2001 | Montaron | |

(Continued)

FOREIGN PATENT DOCUMENTS

| | | | |
|---|---|---|---|
| FR | 2901837 | A1 | 12/2007 |
| GB | 2395214 | A | 5/2004 |

(Continued)

OTHER PUBLICATIONS

PCT Int'l Search Report and The Written Opinion of the Int'l Searching Authority dated Aug. 28, 2013; Int'l App. No. PCT/US2012/055474; Int'l Filing Date: Sep. 14, 2012.

*Primary Examiner* — David Andrews
*Assistant Examiner* — Carib Oquendo
(74) *Attorney, Agent, or Firm* — Bracewell LLP; Constance Gall Rhebergen

(57) ABSTRACT

A bottom hole assembly carrying an expandable tubular is disposed in a portion of a wellbore having a lost circulation zone, and the tubular is radially expanded to isolate the wellbore from the formation across the lost circulation zone. The expandable tubular is made up of a rolled up sheet like member and mounts along the outer periphery of a portion of the bottom hole assembly. A bladder on the bottom hole assembly is inflated for expanding the tubular radially outward against the wellbore wall. A drill bit and under-reamer are included with the bottom hole assembly.

17 Claims, 6 Drawing Sheets

(56) References Cited

U.S. PATENT DOCUMENTS

| | | | | |
|---|---|---|---|---|
| 7,278,406 | B2 * | 10/2007 | Hagler | F02M 25/0854 123/516 |
| 7,350,565 | B2 | 4/2008 | Hall et al. | |
| 7,380,595 | B2 * | 6/2008 | Wetzel | E21B 43/105 166/207 |
| 2003/0015246 | A1 | 1/2003 | Hardin | |
| 2004/0055758 | A1 | 3/2004 | Brezinski et al. | |
| 2005/0023002 | A1 | 2/2005 | Zamora et al. | |
| 2009/0206817 | A1 * | 8/2009 | Ng et al. | 323/303 |
| 2011/0056703 | A1 * | 3/2011 | Eriksen | 166/381 |

FOREIGN PATENT DOCUMENTS

| | | | |
|---|---|---|---|
| WO | 0252124 | A2 | 7/2002 |
| WO | 2007106429 | A2 | 9/2007 |

* cited by examiner

BOTTOM HOLE ASSEMBLY FOR DEPLOYING AN EXPANDABLE LINER IN A WELLBORE

CROSS REFERENCE TO RELATED APPLICATIONS

This application claims priority to and the benefit of U.S. Provisional Application Ser. No. 61/536,789, filed Sep. 20, 2011, the full disclosure of which is hereby incorporated by reference herein for all purposes.

BACKGROUND OF THE INVENTION

1. Field of the Invention

The present invention relates to repairing lost circulation zones in a wellbore. More specifically, the invention relates to repairing a lost circulation zone in a wellbore by radially expanding a sheet like member that is wound into a tubular form within the lost circulation zone.

2. Description of the Related Art

Hydrocarbon producing wellbores extend subsurface and intersect subterranean formations where hydrocarbons are trapped. The wellbores are created by drill bits that are on the end of a drill string, where typically a top drive above the opening to the wellbore rotates the drill string and attached bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore; the drilling fluid then flows back up the wellbore in an annulus between the drill string and walls of the wellbore. Cuttings are produced while excavating and are carried up the wellbore with the circulating drilling fluid.

While drilling the wellbore mudcake typically forms along the walls of the wellbore that results from residue from the drilling fluid and/or drilling fluid mixing with the cuttings or other solids in the formation. The permeability of the mudcake generally isolates fluids in the wellbore from the formation. Seepage of fluid through the mudcake can be tolerated up to a point. Occasionally cracks in a wall of the wellbore allow a free flow of fluid between the wellbore and any adjacent formation, which compromise well control that usually requires corrective action. The cracks may be from voids in the rock formation that were intersected by the bit, or can form due to differences in pressure between the formation and the wellbore.

SUMMARY OF THE INVENTION

Disclosed herein is an example of a bottom hole assembly that in an embodiment includes a mandrel insertable in a wellbore, an inflatable bladder mounted on the mandrel, and a radially expandable tubular roll mounted on the mandrel that circumscribes the bladder. In this example when the bladder is inflated the bladder extends outward into contact against the member and expands the tubular roll radially outward against a wall of the wellbore. A drill bit can be included with the bottom hole assembly that is mounted on an end of the mandrel. An underreamer can also be mounted on the mandrel. In one example, a reamer assembly for selectively enlarging a diameter of the wellbore is provided with the bottom hole assembly. The bottom hole assembly can further include a means for mounting the tubular roll to the mandrel. In this example, the means for mounting the tubular roll to the mandrel are upper and lower running tools set on the mandrel at opposing ends of the tubular roll. In one embodiment, the upper and lower running tools each have an end plate mounted on the mandrel. Shear pins may be included with the running tools for selectively rotatingly coupling the end plates to the mandrel. The running tools can also have end mounts engaging distal ends of the tubular roll that rotate with the tubular roll and thrust bearings disposed between each adjacent end mount and end plate so that the end mounts are rotatable with respect to each adjacent end plate. Bearings may optionally be provided between the end mounts and the mandrel. In one embodiment, the bottom hole assembly can further include a means for inflating the bladder. In an example the means for inflating the bladder includes a sleeve axially moveable within an axial bore in the mandrel from a first position to a second position, wherein when the sleeve is in the first position the sleeve blocks communication between the axial bore in the mandrel. Ports are included with the example means that are formed through a sidewall of the mandrel, where the ports extend radially between the axial bore in the mandrel and an annulus formed between an outer surface of the mandrel and inner surface of the bladder. When the sleeve is in the second position, at least a part of one of the openings is in communication with the axial bore in the mandrel. Alternatively, the tubular roll can be a substantially planar member that is spiral wound to define multiple layers along a radius of the roll. In this example, multiple layers are provided along a radius of the roll when the tubular roll is in a retracted mode and also when the tubular roll is in a deployed mode.

Also disclosed herein is a bottom hole assembly for remediating a fissure in a wall of a wellbore. In this example the bottom hole assembly includes a mandrel having an upper end selectively connected to a drill string and a lower end coupled with a drill bit. A channel axially projects through the drill string and the mandrel and a tubular seal mounts on the mandrel that is rotatable with respect to the mandrel. Also in this embodiment a selectively inflatable bladder mounts on the mandrel in a position circumscribed by the tubular seal and that projects radially outward in response to an increase of pressure in an annular space between the bladder and the mandrel to radially expand the tubular seal outward and into sealing engagement with an inner surface of the wall of the wellbore. In one alternate example, the tubular seal is formed from a planar member that is spiral wound into a tubular roll. Optionally, the bottom hole assembly can further have an underreamer assembly that includes cutters for excavating a wider diameter wellbore than the drill bit. Further optionally included with the bottom hole assembly is a bladder inflation system. In an example, the bladder inflation system includes a sleeve in the channel that is axially moveable from a blocking position that blocks flow from within the channel to the annular space, to an open position that communicates flow from within the channel to the annular space. The bottom hole assembly can further include a port projecting through a sidewall of the mandrel, wherein the sleeve is between the port and the channel when in the blocking position and wherein a terminal end of the sleeve is offset from a path between the port and the channel when in the open position.

A method of treating a lost circulation zone in a wellbore is provided herein. In an example the method includes excavating in the wellbore with a drill bit that is mounted on a lower end of a drill string, disposing a radially expandable tubular in the wellbore adjacent the lost circulation zone and that circumscribes a mandrel coupled with the drill string, and inflating the bladder to urge the tubular radially outward into sealing engagement with a wall of the wellbore adjacent the lost circulation zone thereby forming a seal between the lost circulation zone and wellbore. The method can further optionally includes excavating the wellbore to a location past the lost circulation zone. In an alternate example, the expandable tubular is made of a planar sheet that is spiral wound into tubular form so that multiple layers of the sheet are disposed along a radius of the tubular. The method can further include a step of underreaming the wellbore adjacent the lost circulation zone.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
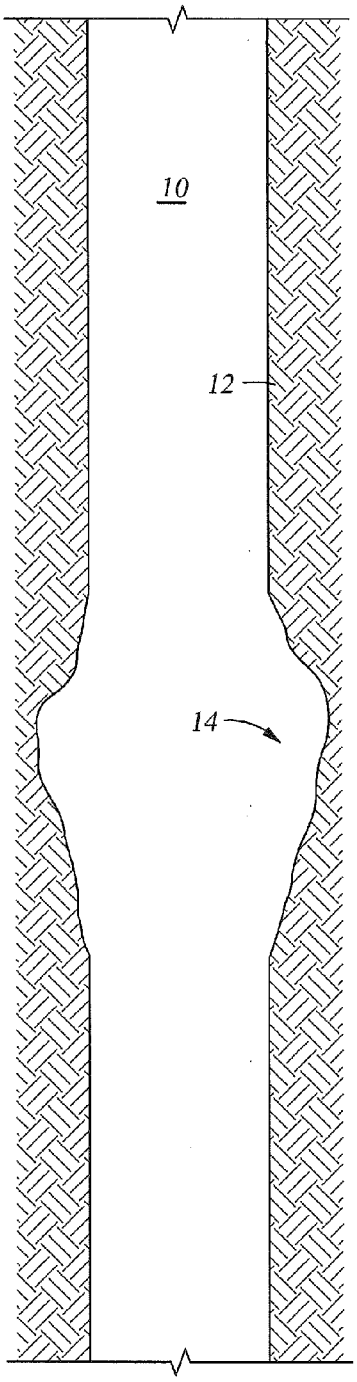
FIG. 1 is a side sectional view of a portion of a wellbore having a lost circulation zone.
Figure 2:
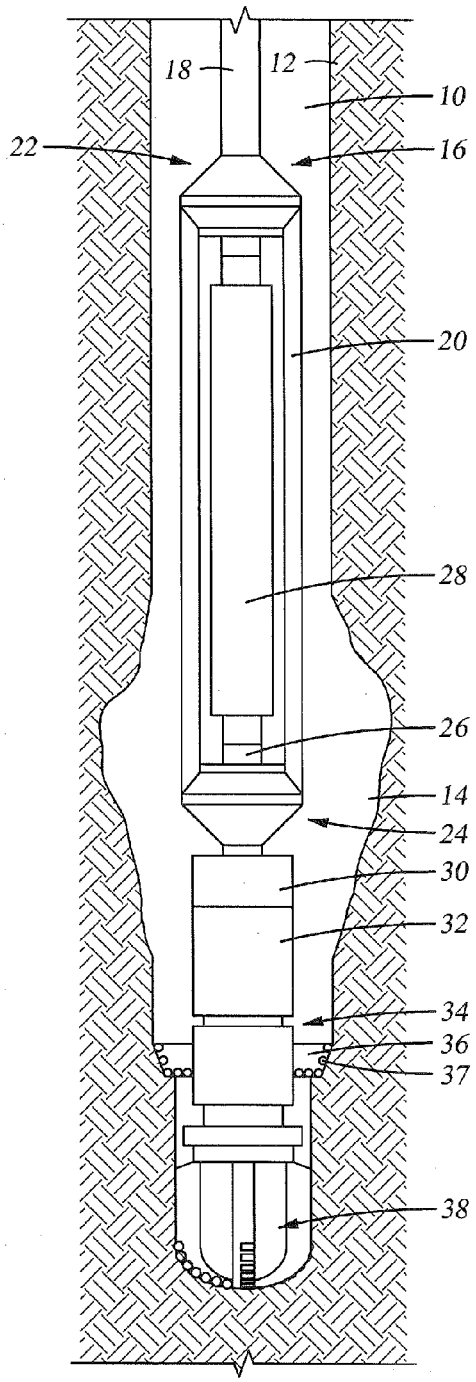
FIG. 2 is a side partial sectional view of an example embodiment of a bottom hole assembly disposed in the wellbore of FIG. 1 in accordance with the present invention.

A wellbore 10 is shown in a side sectional view in FIG. 1, where the wellbore 10 is formed through a formation 12. Fractures 14 are depicted along a wall of the wellbore 10 that allow a sufficient amount of flow between the wellbore 10 and formation 12 to constitute a lost circulation zone. In one example, a lost circulation zone is defined where flow between the wellbore 10 and formation 12 is above a designated amount and deemed to require remediation. It is within the capabilities of those skilled in the art to identify a lost circulation zone and determine a designated amount of flow. Optionally, the fractures 14 may represent a wash out area or otherwise unconsolidated zone. Referring to FIG. 2, an example of a bottom hole assembly (BHA) 16 is shown being inserted into the wellbore 10. In an exemplary embodiment of use, the BHA 16 is used for repairing the lost circulation zone by isolating the formation 12 from the borehole 10 by lining the portion of the wellbore 10 adjacent the fractures 14. In the example embodiment of FIG. 2, the BHA 16 is deployed on a lower end of a drill string 18 and includes an expandable liner 20 along a portion of its outer circumference. The liner 20 is shown held between top and bottom running tools 22, 24 that coaxially mount on opposing ends of a cylindrical mandrel 26. In the example of FIG. 2, the mandrel 26 is substantially aligned with the lower end of the drill string 18. Also on the mandrel 26 is an inflatable bladder 28 between the top and bottom running tools 22, 24 set in the annular space between the mandrel 26 and expandable liner 20.

Further illustrated in the example embodiment of FIG. 2 is an optional measurement while drilling device (MWD) 30 provided on a lower end of the mandrel 26 that is distal from the drill string 18. Also optionally provided in this example is a mud motor 32 mounted on the side of the MWD 30 opposite its attachment to the mandrel 26. An underreamer assembly 34 is coupled on the end of the mud motor 32 opposite the MWD 30. The underreamer assembly 34 includes arms 36 that have an end pivotingly coupled to the underreamer assembly 34 and cutters 37 on the arms 36. The arms 36 can selectively pivot radially outward from the underreamer assembly 34 so that the cutters 37 are engaged with the sidewalls of the wellbore 10, that in an example increase the diameter of the wellbore 10. On the lower terminal end of the BHA 16 is a drill bit 38. In the example embodiment of FIG. 2, the drill bit 38 is used for forming the primary wellbore 10, and selectively extending the underreamer arms 36 radially outward increases the diameter of the borehole 10 to a diameter greater than that created by the drill bit 38.

Figures 3, 4:
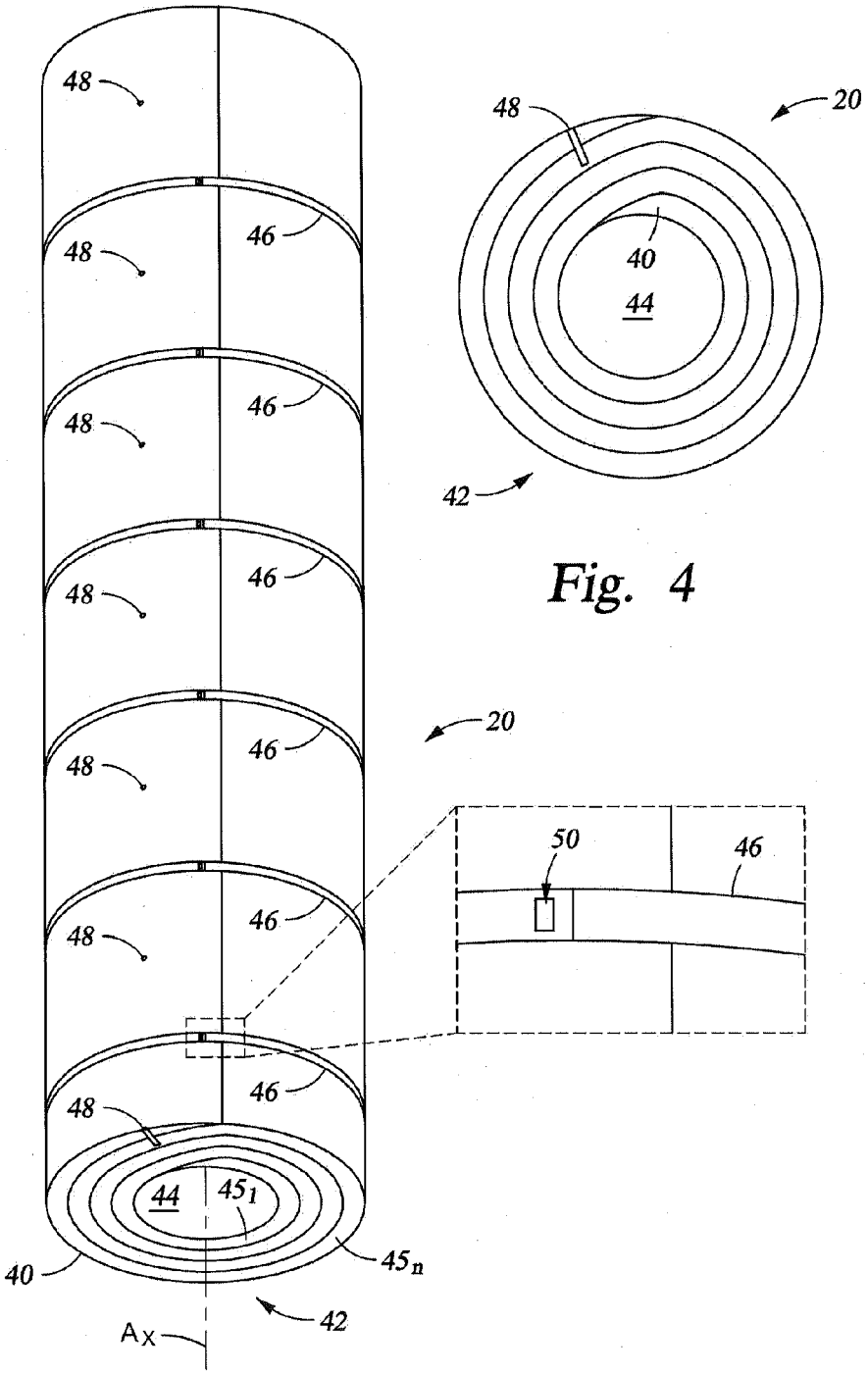
FIG. 3 is a side perspective view of an expandable tubular in accordance with the present invention.
FIG. 4 is an end view of the expandable tubular of FIG. 3 in accordance with the present invention.

A perspective view of the expandable liner 20 is shown in FIG. 3 wherein the expandable liner 20 is shown to include a sheet-like member 40 that has been rolled into a tubular roll 42. The member 40 can be made from various materials, such as metal, composites, elastomers, and the like, and combinations thereof. In one example embodiment, the member 40 is made of material having an elastic characteristic so that when formed into the roll 42 of FIG. 3 the member 40 deforms elastically so that internal stresses remain within the roll 42. Maintaining the internal stresses in the roll 42 stores a potential force in the member 40 that exerts a biasing force that attempts to radially expand the expandable liner 20 from its tubular shape of FIG. 3 to its original planar configuration. The roll 42 includes an axial bore 44 that extends through the length of the expandable liner 20. Wrapping the member 40 into the roll 42 defines a number of layers $\mathbf{45}_1$-$\mathbf{45}_n$ between the bore 44 and outer surface of the roll 42.

In the embodiments when material making up the member 40 is elastic, retaining means may be included with the expandable liner 20 to retain the configuration of the roll 42. Example retaining means includes belts 46 that circumscribe the roll 42 at increments along the length of the expandable liner 20. Optionally, fasteners 48 may be included that are inserted into the side of the roll 42. The fasteners 48 may be threaded and driven into a side of the liner 20 to self thread a hole in the side of the roll 42 or into an existing hole in the roll 42. Moreover, the belts 46 may include a latch 50 as shown in the insert portion of FIG. 3. An example of the fastener 48 being threaded in engaging the threaded hole is shown in the side sectional view in FIG. 4. Also, the lateral edges of the member 40 that extend axially along the roll 42 are shown as angled or tapered to maintain a substantially circular profile on the outer periphery of the roll 42 and the bore 44. Alternate embodiments exist, wherein the lateral terminal ends of the member 40 have a thickness roughly the same as the thickness of other portions of the member 40; including end surfaces of the member 40 that are largely perpendicular to the outer surface of the roll 42 and outer periphery of the bore 44.

Figure 5:
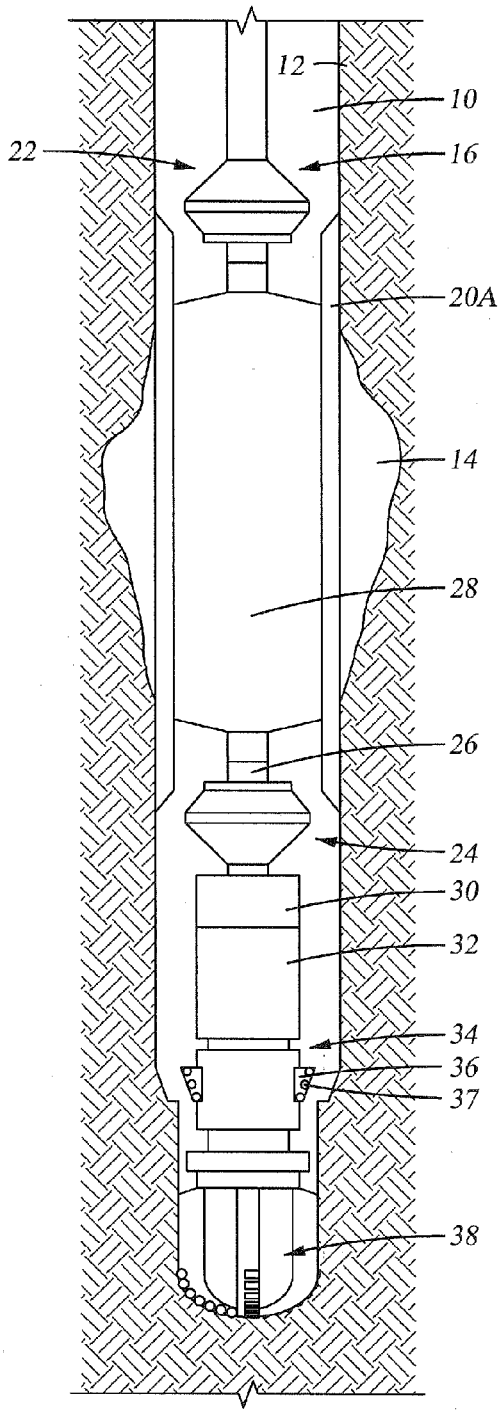
FIG. 5 is a side partial sectional view of the bottom hole assembly of FIG. 2 setting an expandable tubular in the wellbore in accordance with the present invention.

FIG. 5 illustrates in a side partial sectional view the expandable liner 20A changed from its running configuration of FIG. 2 and into a deployed configuration. When in the deployed configuration the outer surface of the liner 20A is set against the inner surface of the wellbore 10. Strategically locating the expandable liner 20A in the wellbore 10 adjacent the fracture 14 when the liner 20 is changed into the deployed configuration positions the deployed expandable liner 20A between the wellbore 10 and the fracture 14, thereby isolating flow between the wellbore 10 and formation 12 through the fracture 14. In an example, forming the deployed expandable liner 20A occurs by inflating the bladder 28 so that it expands radially outward from the mandrel 26 and against the inner circumference of the bore 44. While being inflated, the bladder 28 applies outward radial forces against the rolled up liner 20 that fractures shear pins 48 and or belts 46. Continued inflation of the bladder 28 causes adjacent layers $\mathbf{45}_i$-$\mathbf{45}_{i+1}$ (where i ranges from 1 to n−1) to slide with respect to one another and along a line substantially tangential to an axis $A_x$ (FIG. 4) of the roll 42. The liner 20 unrolls with sliding between adjacent layers $\mathbf{45}_i$-$\mathbf{45}_{i+1}$ changing the expandable liner 20 from the running configuration (FIG. 2) into the deployed and larger radius configuration. An advantage of the multiple layers $\mathbf{45}_i$-$\mathbf{45}_n$ is that the liner 20 will not completely unroll within the wellbore 10, but instead at least one layer $\mathbf{45}_i$-$\mathbf{45}_n$ will be present between the annulus of the wellbore 10 and wall of the wellbore 10.

Figure 6:
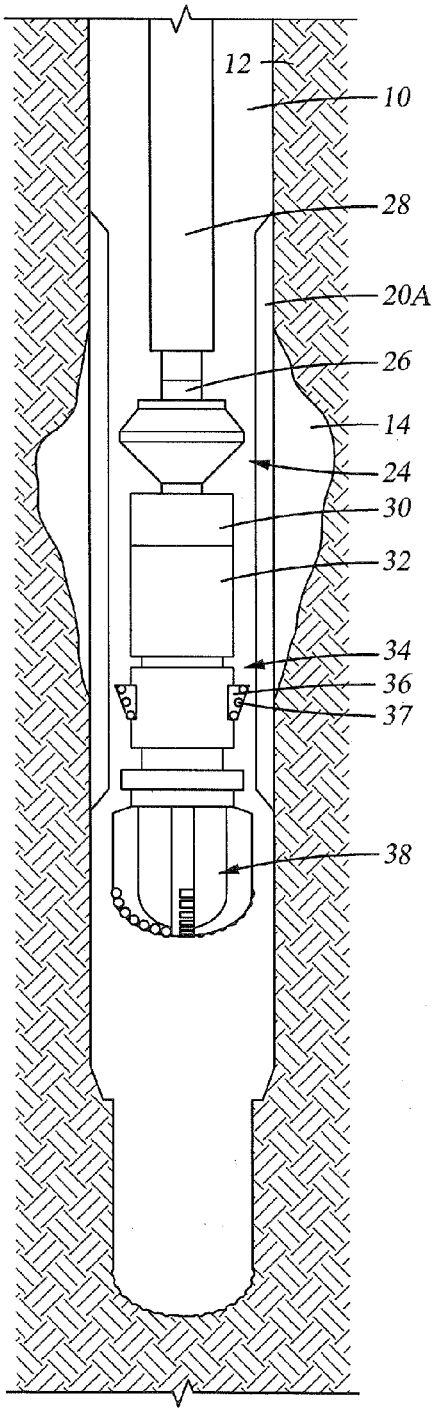
FIG. 6 is a side partial sectional view of the bottom hole assembly of FIG. 5 being removed from the wellbore in accordance with the present invention.

Also illustrated in FIG. 5 are that the reamer arms 36 are pivoted to a stowed position adjacent the underreamer assembly 34 so that the underreamer assembly 34 has an outer diameter at about or less than that of the bit 38. Thus, by deflating the bladder 28 as shown in the side partial sectional view of FIG. 6, the BHA 16 can axially move within the inner circumference of the now enlarged expandable liner 20A and be removed from the wellbore 10. Optionally, the BHA 16 can remain in the wellbore 10 and drill string 18 and bit 38 can be rotated for lengthening the wellbore 10.

Figure 7A:
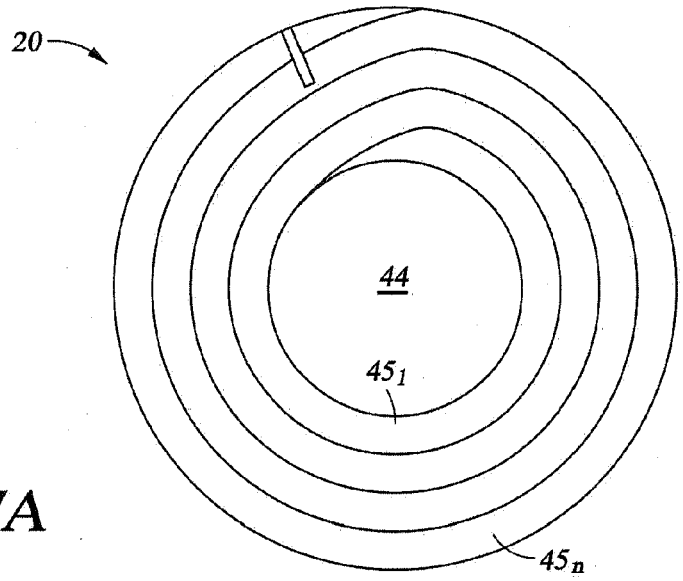
FIG. 7A is an end view of an expandable tubular configured in a running position in accordance with the present invention.
Figure 7B:
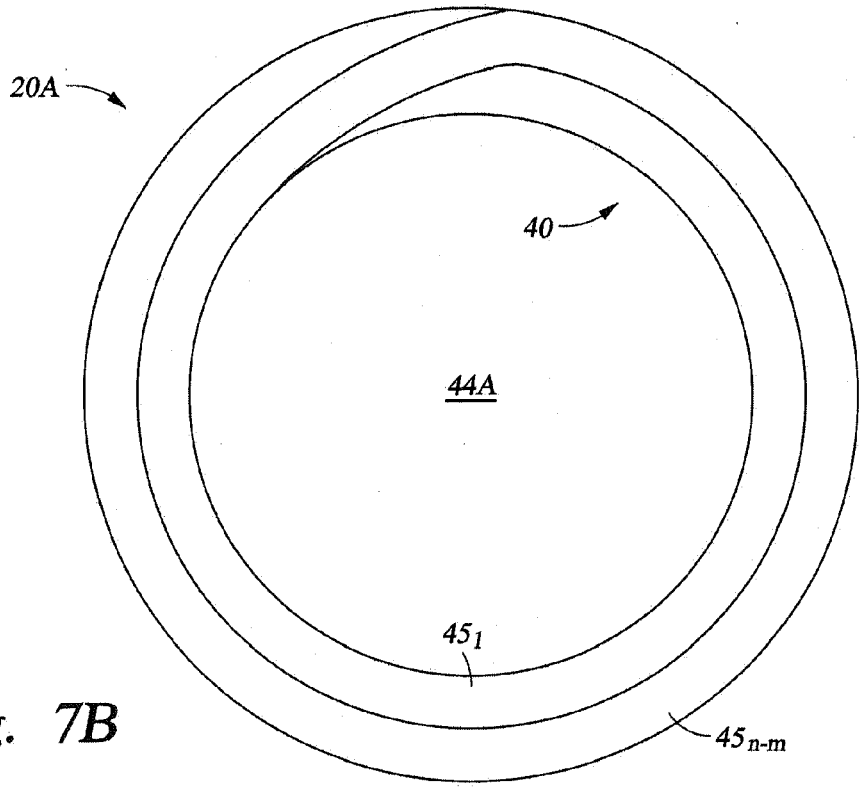
FIG. 7B is an end view of the expandable tubular of FIG. 7A configured in a deployed position in accordance with the present invention.

Side sectional views of the expandable tubular 20 in its running condition and the expandable tubular 20A in its deployed configuration are respectively provided in FIGS. 7A and 7B. In FIG. 7A, the outer diameter of the expandable liner 20 is reduced from that of the expandable liner 20A shown in 7B. Similarly, the diameter of the bore 44 in the running configuration of FIG. 7A is less than the diameter of the bore 44A of the expandable liner 20A in its deployed configuration in 7B. As indicated above, while changing from the running to the deployed configuration the expandable liner 20 is partially unrolled, so that the layers $\mathbf{45}_1$-$\mathbf{45}_{n-m}$ making up the liner 20A are fewer than the layers $\mathbf{45}_1$-$\mathbf{45}_n$ making up the liner 20.

Figure 8:
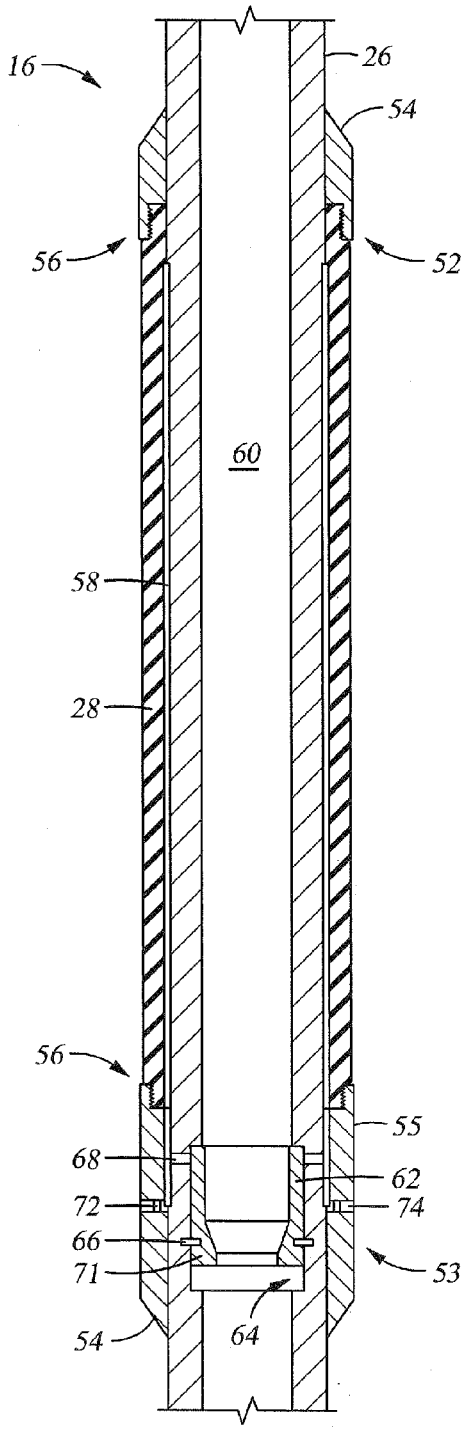
FIG. 8 is a side sectional view of a portion of a bottom hole assembly in a running configuration in accordance with the present invention.

FIG. 8 shows a side sectional view of a portion of the BHA 16 having the inflatable bladder 28. As illustrated in FIG. 8, mount assemblies 52, 53 attach on the outer surface of the mandrel 26 respectively at upper and lower ends of the bladder 28. Each mount assembly 52, 53 circumscribes the mandrel 26 and has a base portion 54 attached on the outer surface of the mandrel 26. An annular-shaped wall 55 extends upward from the base 54 of mount assembly 53. The wall 55 is set radially outward from the outer surface of the mandrel 26. A slot 56 is provided on the free end of the wall 55 distal from where the wall 55 attaches to the base 54. Another slot 56 is provided on an end of the mount assembly 52 facing mount assembly 53. The slots 56 from each of the mount assemblies 52, 53 project one another. Slots 56 are set radially outward from the outer surface of the mandrel 26. In the example of FIG. 8, opposing lateral ends of the bladder 28 respectively attach within oppositely facing slots 56. Retaining the bladder 28 in radially offset slots 56 defines an annulus 58 between the bladder 28 and mandrel 26.

Further illustrated in the example mandrel 26 of FIG. 8 is an axial bore 60 and a sliding sleeve 62. The sliding sleeve 62 is coaxially to the bore 60 and slidable within a slot 64 formed in the mandrel 26 axially along the outer surface of the bore 60. Shear pins 66 are provided within the sleeve 62 that extend into the body of the mandrel 26 for retaining the sleeve 62 in the configuration shown in FIG. 8. Ports 68 are formed radially through a side wall of the mandrel 26 between the annulus 58 and slot 64. When in the example configuration of FIG. 8, the sleeve 62 is set adjacent to the ports 68 thereby blocking communication between the annulus 58 and slot 64 through the ports 68. Applying a force to the sleeve 62 that fractures the shear pins 66 and moves the sleeve 62 axially within the slot 64 provides communication between the annulus 58 and bore 60 via the ports 68.

Figure 9:
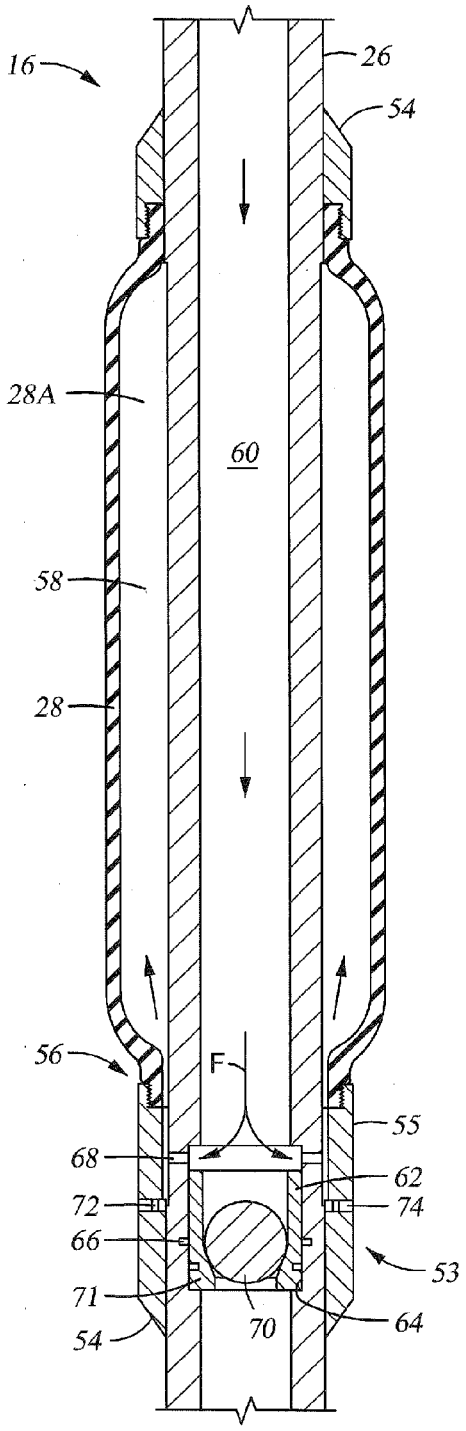
FIG. 9 is a side sectional view of the bottom hole assembly of FIG. 8 and in a deployed configuration in accordance with the present invention.

Referring now to the example embodiment of FIG. 9, a ball 70 is shown landed within a ledge 71 provided on a lower portion of the sleeve 62. The ledge 71 is defined where an inner radius of the sleeve 62 projects radially inward. The ball 70 can be dropped into a bore (not shown) in the drill string 18 (FIG. 2) from surface. In an example embodiment, the ball 70 is used to generate a force F that fractures the shear pins 66, thereby releasing the sleeve 62 from the mandrel 26 and urging the sleeve 62 downward and axially within the slot 64. The shearing and/or urging force F can be from gravitational forces on the ball 70 that transfer to the sleeve 62 when the ball 70 is captured by the ledge 71, acceleration of the ball 70 landing in the ledge 71, or by pressurizing fluid within the bore 60 above the ball 70 that urge the ball 70 and sleeve 62 downward. As discussed above, moving the sleeve 62 as illustrated in FIG. 9 allows fluid communication from the bore 60 and into the annulus 58 via the ports 68.

In the example of FIG. 9, the bladder 28A is formed from an elastic material, such as a polymeric elastomer, so that the pressurized fluid flowing into the annulus 58 from the bore 60 forms the radially expanded bladder 28A. As such, the bladder 28A as illustrated in FIG. 9 is an example of a deployed configuration of the bladder 28 as shown in FIG. 5 and discussed above. Further provided in the example embodiment of FIG. 9 is a rupture disk 72 having a side in communication with the annulus 58 so that in the event excess pressure is within the annulus 58 the disk 72 can fracture and allow flow from within the annulus and through an exit port 74 shown extending radially through a portion of the base 54. In one example, the bladder 28 can be deflated by lowering pressure in the bore 60 to a value below the pressure in the wellbore 10.

Figure 10:
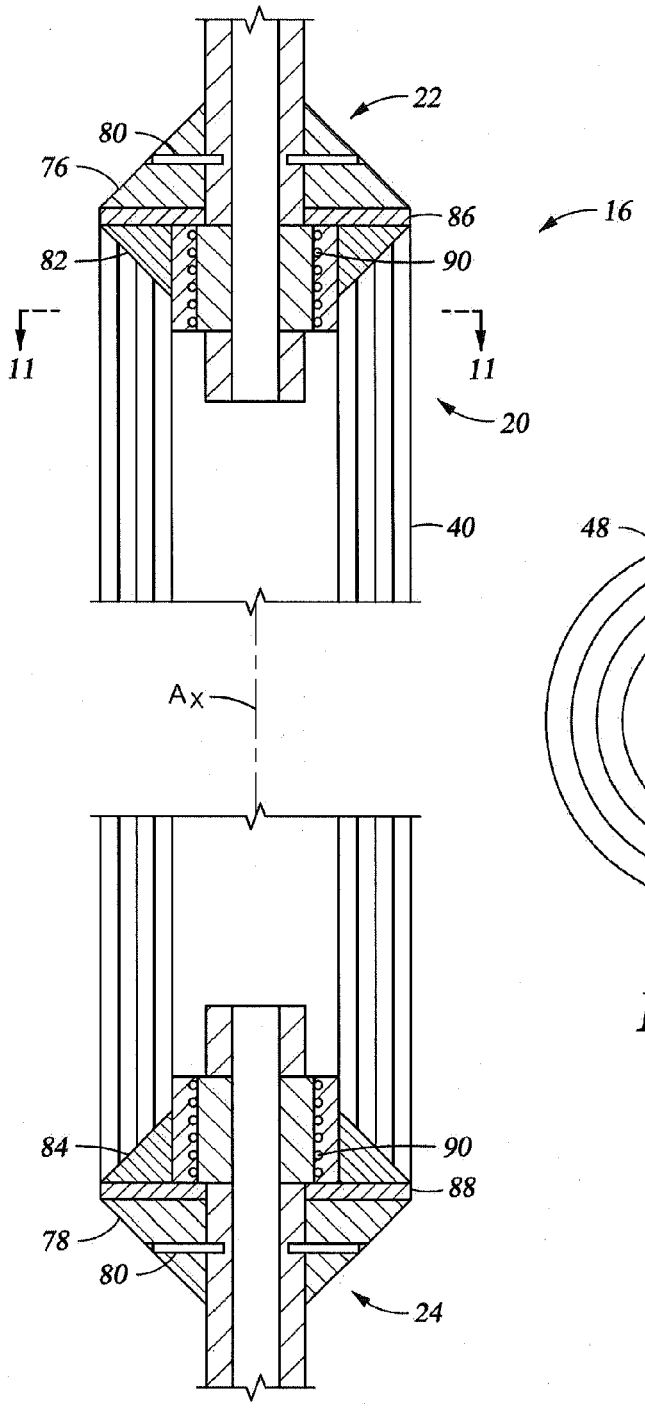
FIG. 10 is a side sectional view of an example embodiment of a portion of a bottom hole assembly in accordance with the present invention.
Figure 11:
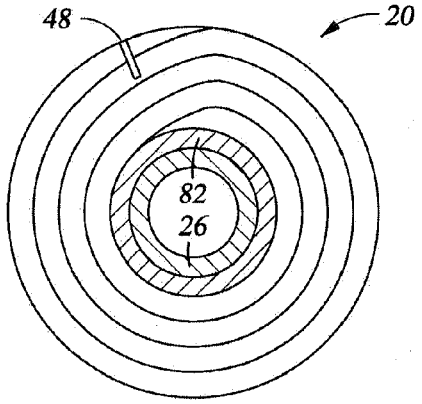
FIG. 11 is an end view of an expandable tubular included with the bottom hole assembly of FIG. 10 in accordance with the present invention.

Shown in a side sectional view in FIG. 10 are details of the top and bottom running tools 22, 24 of the BHA 16. In the example of FIG. 10, the top and bottom running tools 22, 24 include plates 76, 78 that have outer surfaces that taper radially inward with distance away from the expandable liner 20. Shear pins 80 retain the end plates 76, 78 to the mandrel 26. Thus, with rotation of the mandrel 26, the end plates 76, 78 will also rotate. Ring-like end mounts 82, 84 are respectively provided between the end plates 76, 78 and the expandable liner 20. In the example of FIG. 10, the interface between the end mounts 82, 84 and opposing lateral ends of the expandable tubular run 20 along a line angled oblique to an axis $A_x$ of the mandrel 26. The end mounts 82, 84 are configured to be substantially static with respect to the expandable liner 20, and as such may remain stationary with rotation of the mandrel 26 and end plates 76, 78. Optional thrust bearings 86, 88 are shown provided between the end plates 76, 78 and end mounts 82, 84 to reduce sliding frictional forces between the end plates 76, 78 and end mounts 82, 84 as they rotate with respect to one another. Also, roller bearings 90 may optionally be provided along the axial interface between the end mounts 82, 84 and outer surface of the mandrel 26. Shown in a side sectional view and taken along lines 11-11 is an illustration depicting the interface between the expandable liner 20 and mount 82. Shown coaxial within the end mount 82 is the mandrel 26. A shear pin 48 is shown set within the outer surface of the expandable liner and illustrating the expandable liner 20 in a running configuration.

What is claimed is:

1. A bottom hole assembly for remediating a fissure in a wall of a wellbore comprising:

a mandrel having an upper end selectively connected to a drill string and a lower end coupled with a drill bit;

a channel axially projecting through the drill string and the mandrel;

a tubular seal comprising a solid planar member that is spiral wound into a tubular roll and that is mounted on the mandrel that is rotatable with respect to the mandrel;

a means for mounting the roll to the mandrel comprises upper and lower running tools set on the mandrel at opposing ends of the roll, the upper and lower running tools each having an end plate mounted on the mandrel;

shear pins selectively rotatingly coupling the end plates to the mandrel;

end mounts engaging distal ends of the roll that rotate with the roll;

a thrust bearing disposed between each adjacent end mount and end plate so that the end mounts are rotatable with respect to each adjacent end plate; and a selectively inflatable bladder mounted on the mandrel in a position circumscribed by the tubular seal and that projects radially outward in response to an increase of pressure in an annular space between the bladder and the mandrel to radially expand the tubular seal outward and into sealing engagement with an inner surface of the wall of the wellbore.

2. The bottom hole assembly of claim 1, wherein more than one layer is formed along a radius of the tubular seal by rolling the planar member into a tubular roll.

3. The bottom hole assembly of claim 1, further comprising an under reamer assembly that includes cutters for excavating a wider diameter wellbore than the drill bit.

4. The bottom hole assembly of claim 1, further comprising a bladder inflation system comprising a sleeve in the channel that is axially moveable from a blocking position that blocks flow from within the channel to the annular space to an open position that communicates flow from within the channel to the annular space.

5. The bottom hole assembly of claim 4, further comprising a port projecting through a sidewall of the mandrel, wherein the sleeve is between the port and the channel when in the blocking position and wherein a terminal end of the sleeve is offset from a path between the port and the channel when in the open position.

6. A method of treating a lost circulation zone in a wellbore comprising:

providing a drill string comprising;

a drill bit on an end of drill pipe, a mandrel, a tubular that circumscribes the mandrel and that is formed by rolling a solid planar member so that the tubular has a spiraling cross section of multiple layers of the planar member, an upper running tool on the mandrel at an end of the tubular and having an end plate attached to the mandrel with a shear pin, a lower running tool on the mandrel at an end of the tubular opposite from the upper running tool, and having an end plate attached to the mandrel with a shear pin, end mounts engaging opposing ends of the tubular, a thrust bearing between each adjacent end mount and end plate, so that the end mounts rotate with rotation of the tubular;

excavating in the wellbore with the drill string;

disposing the tubular in the wellbore adjacent the lost circulation zone; and rotating one of the upper or lower running tools with respect to the other to radially expand the tubular radially outward into sealing engagement with a wall of the wellbore adjacent the lost circulation zone thereby forming a seal between the lost circulation zone and wellbore.

7. The method of claim 6, further comprising further excavating the wellbore at a location past the lost circulation zone.

8. The method of claim 6, wherein winding the planar sheet into the tubular defines multiple layers of the member that are disposed along a radius of the tubular.

9. The method of claim 6, further comprising underreaming the wellbore adjacent the lost circulation zone.

10. The method of claim 6, wherein rolling the planar member so that the tubular has a spiraling cross section of multiple layers of the planar member forms internal stresses in the planar member, the method further comprising maintaining the internal stresses within the tubular to store a potential force in the planar member.

11. A bottom hole assembly comprising:

a mandrel insertable in a wellbore;

an inflatable bladder mounted on the mandrel; and a radially expandable roll that comprises a solid planar member that is wound into a tubular configuration to have a spiral cross section with multiple layers, and that is mounted on the mandrel and circumscribing the bladder, so that when the bladder is inflated the bladder extends outward into contact against the roll to unwind the roll and expand the tubular roll radially outward to isolate flow between the wellbore and a formation around the wellbore;

a fastener that radially intersects more than one of the layers and maintains the solid planar tubular member wound into the tubular configuration; and a means for mounting the roll to the mandrel that comprises upper and lower running tools set on the mandrel at opposing ends of the roll, the upper and lower running tools each comprising an end plate mounted on the mandrel, shear pins selectively rotatingly coupling the end plates to the mandrel, end mounts engaging distal ends of the roll that rotate with the roll, a thrust bearing disposed between each adjacent end mount and end plate so that the end mounts are rotatable with respect to each adjacent end plate.

12. The bottom hole assembly of claim 11, further comprising a drill bit on an end of the mandrel and an underreamer mounted on the mandrel.

13. The bottom hole assembly of claim 11, wherein when the planar member is wound into the tubular configuration, the planar configuration defines layers that make up the spiral cross section, the bottom hole assembly further comprising a retainer to keep the roll in an unexpanded configuration and that consists of an element selected from the group consisting of a fastener that radially intersects more than one of the layers, a belt that circumscribes the roll, and combinations thereof.

14. The bottom hole assembly of claim 11, further comprising bearings between the end mounts and the mandrel.

15. The bottom hole assembly of claim 11, further comprising a means for inflating the bladder that comprises a sleeve axially moveable within an axial bore in the mandrel from a first position to a second position, wherein when the sleeve is in the first position the sleeve blocks communication between the axial bore in the mandrel and ports formed through a sidewall of the mandrel, where the ports extend radially between the axial bore in the mandrel and an annulus formed between an outer surface of the mandrel and inner surface of the bladder, and wherein when the sleeve is in the second position, at least a part of one of the ports is in communication with the axial bore in the mandrel.

16. The bottom hole assembly of claim 11, wherein the roll comprises more than one layer along a radius of the roll, and wherein the more than one layer exists along the radius of the roll when the tubular roll is in a retracted mode and exists when the tubular roll is in a deployed mode.

17. The bottom hole assembly of claim 11, wherein the number of layers along the radius of the roll when the roll is in the deployed mode is less than the number of layers along the radius of the roll when the roll is in the retracted mode.

* * * * *